US005505588A

United States Patent [19]

Brühwiler et al.

[11] Patent Number: 5,505,588

[45] Date of Patent: Apr. 9, 1996

[54] COMPRESSOR WITH GAS SEALING CHAMBER

[75] Inventors: Eduard Brühwiler, Turgi; Paul Marlow, Baden, both of Switzerland

[73] Assignee: ABB Management AG, Baden, Switzerland

[21] Appl. No.: 310,776

[22] Filed: Sep. 27, 1994

[30] Foreign Application Priority Data

Nov. 2, 1993 [DE] Germany ..... 43 37 281.3

[51] Int. Cl.[6] ..... F01D 11/00

[52] U.S. Cl. ..... 415/112; 415/116

[58] Field of Search ..... 415/110, 111, 415/112, 116, 121.2, 173.7

[56] References Cited

U.S. PATENT DOCUMENTS

| | | | |
|---|---|---|---|
| 4,190,397 | 2/1980 | Schilling et al. | 415/112 |
| 4,554,789 | 11/1985 | Napoli et al. | 415/112 |
| 4,662,821 | 5/1987 | Kervistin et al. | 415/116 |
| 4,668,163 | 5/1987 | Kervistin | 415/116 |
| 4,668,164 | 5/1987 | Neal et al. | 415/116 |
| 4,721,433 | 1/1988 | Plendel et al. | 415/116 |
| 5,028,204 | 7/1991 | Kulle et al. | 415/112 |

FOREIGN PATENT DOCUMENTS

| | | | |
|---|---|---|---|
| 0197401 | 11/1983 | Japan | 415/121.2 |
| 0267494 | 6/1950 | Sweden | 415/173.7 |
| 0850261 | 10/1960 | United Kingdom | 415/121.2 |

*Primary Examiner*—Edward K. Look
*Assistant Examiner*—Mark Sgantzos
*Attorney, Agent, or Firm*—Burns, Doane, Swecker & Mathis

[57] ABSTRACT

A compressor for a gas turbine includes a gas seal chamber to seal the space between the guide vanes and the rotor vanes from ambient air. A seal casing is positioned at a radially inner side of the inlet casing adjacent to an inlet duct and the rotor blades with an annular gap between the seal casing and the rotor shaft. The annular gap communicates for air flow with the inlet duct. A plurality of ribs are mounted on the one or both of the seal casing and rotor shaft to extend into the annular gap to provide flow resistance. The seal casing defines therewithin a sealing air chamber is connected to the inlet space and the annular gap to permit air from the inlet space to flow to the annular gap and to the inlet duct.

7 Claims, 5 Drawing Sheets

COMPRESSOR WITH GAS SEALING CHAMBER

BACKGROUND OF THE INVENTION

1. Field of the Invention

The present invention relates to the field of turbomachines. It concerns a compressor, in particular for gas turbines, including (a) a rotor shaft which can be rotated about a compressor center line and which has a plurality of rotor blades fastened at its periphery;

(b) a compressor casing surrounding the rotor shaft in the region of the rotor blades;

(c) an inlet casing surrounding the rotor shaft at the inlet end of the compressor and having an outer shell and an inner shell between which is formed an inlet space for the air to be compressed, which inlet space is in connection with the surroundings at one end by means of an air inlet provided with an inlet filter and merges at the other end into an induction duct equipped with adjustable or fixed inlet guide vanes, the outer shell adjoining the compressor casing; and (d) a seal casing on the end of the inner shell facing toward the rotor blades, which seal casing, located at the periphery of the rotor shaft, seals the induction duct against the surroundings and includes a sealing air chamber from which sealing air can emerge into the annular gap between the seal casing and the rotor shaft.

Such a compressor is known, for example, from the article by J. P. Smed and H. Saeki, A NEW DESIGN FOR A COMPRESSOR INLET CASING ATMOSPHERIC VENT SYSTEM, ASME Cogen-Turbo, IGTI-Vol. 7, pp. 535–537 (ASME 1992).

2. Discussion of Background

In compressors, such as are used as part of a gas turbine, measures must be taken in order to seal spaces with different pressures on the rotating rotor shaft against one another during operation so that the efficiency of the compressor remains high and so that faults—such as can be initiated by lubricating oil from the bearings entering the compressor duct—are reliably avoided.

One possible type of seal is sealing with air under pressure, such as is described in US-A-3,031,132 for the gas turbine of an aircraft. In this, the rotor shaft is annularly surrounded at the position to be sealed by a seal chamber accommodated in a corresponding seal casing. The sealing air under pressure can emerge from the seal chamber into the annular gap between the seal casing and the rotor shaft and, by this means, limit or completely prevent the penetration of undesirable media into the annular gap. In this arrangement, the compressed air is generally tapped from a pressure stage, or optionally a plurality of pressure stages, of the compressor and is fed into the seal chamber by means of a suitable valve circuit and control system.

Such a compressed air seal can be arranged at various positions on the compressor. In the US patent cited, the seal casing—which can, simultaneously, also undertake cooling tasks—is arranged near the high-pressure end shaft bearing of the compressor. In the publication mentioned at the beginning, a compressor is described (see FIGS. 1 and 2 in that publication) in which the seal is arranged at the inlet end journal bearing where the rotor shaft emerges and the compressor casing merges into the inlet casing. This is principally intended to prevent unfiltered and possibly oil-contaminated external air from being forced into the inlet end, low-pressure part of the compressor via the bearings and mixing with the compressor air.

Where the compressor is operated with fixed or slightly altering parameters, the requirements for the compressed air sealing remain within tolerable limits. This solution becomes impracticable, however, if adjustable inlet guide vanes permitting the inlet air-flow to be throttled to a substantial extent at part-load are provided at the inlet to the compressor. In the case of severe throttling, the air pressure in the compressor reaches the atmospheric level after approximately the third compression stage at the earliest, and it is therefore necessary to take the compressed air from the fifth stage or later. If, on the other hand, no throttling occurs, the temperature and pressure of the compressed air taken from the fifth stage or later are, at 180° C. and 4 bar, too high so that a switch-over valve is necessary for tapping the compressed air from a cooler stage.

In the publication mentioned at the beginning (Smed and Saeki), a seal operating with air has already been proposed which can operate without external inspection and control circuits (FIG. 4). This is achieved by admitting cooling air at atmospheric pressure through a passage to the seal chamber which is intended to separate the induction end of the compressor, which is subjected to a vacuum, from the bearings, which are likewise subject to a vacuum but to a smaller vacuum.

This known solution, however, introduces one main problem. The inlet-end cooling air has not generally been subjected to any special filtering so that here again, impurities can be introduced into the compressor duct (via the sealing air).

SUMMARY OF THE INVENTION

Accordingly, one object of the invention is to provide a novel compressor with a seal in which the danger of contamination is substantially reduced.

The object is achieved in a compressor of the type mentioned at the beginning, wherein (e) the seal chamber is in connection with the inlet space by means of at least one sealing air passage.

The core of the invention consists in tapping the sealing air behind the inlet filter and before the inlet guide vanes from the inlet space, the extraction preferably taking place before the induction duct. At this location, filtered air is available at approximately atmospheric pressure and this air can therefore fulfil the desired sealing tasks.

A preferred embodiment of the invention is one wherein (a) a plurality of sealing ribs are arranged one behind the other in the direction of the compressor center line in the annular gap between the seal casing and the rotor shaft, which sealing ribs, starting alternately from the seal casing and the rotor shaft, protrude into the annular gap and define a radial clearance by their distance from the opposite side; and (b) the sealing ribs are subdivided into two groups and the sealing air flows out of the sealing air chamber into the annular gap through a sealing air opening arranged between the two groups.

The ratio between the quantities of sealing air and ambient air flowing through the annular gap can be optimized in a simple manner by the division of the sealing ribs. Optimization between part load (adjustable inlet guide vanes) and full load is similarly possible.

Further embodiments are given in the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
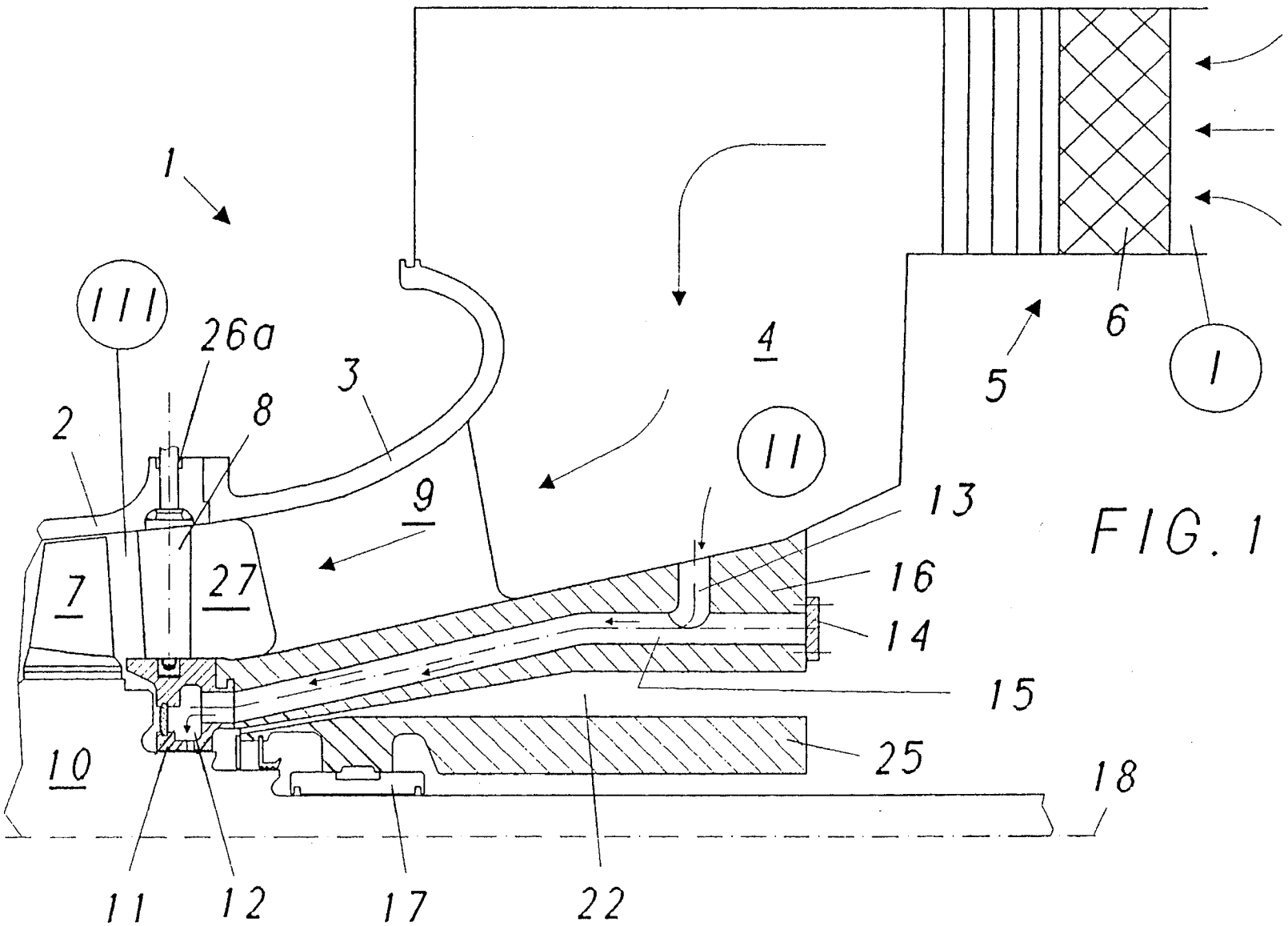
FIG. 1 shows, in longitudinal section, a part of the induction end in accordance with a preferred embodiment example of the compressor according to the invention.

Referring now to the drawings, wherein like reference numerals designate identical or corresponding parts throughout the several views in FIG. 1, the induction end of a preferred embodiment example of a compressor in accordance with the invention is shown, in longitudinal section. The compressor 1 includes a rotor shaft 10 which can be rotated about a compressor center line 18. The rotor shaft 10 emerges at the right-hand end of the figure and is equipped at the left-hand end with a plurality of rotor blades 7 fastened at its periphery. Of these, only the rotor blades of the first stage are shown in the figure.

Figure 2:
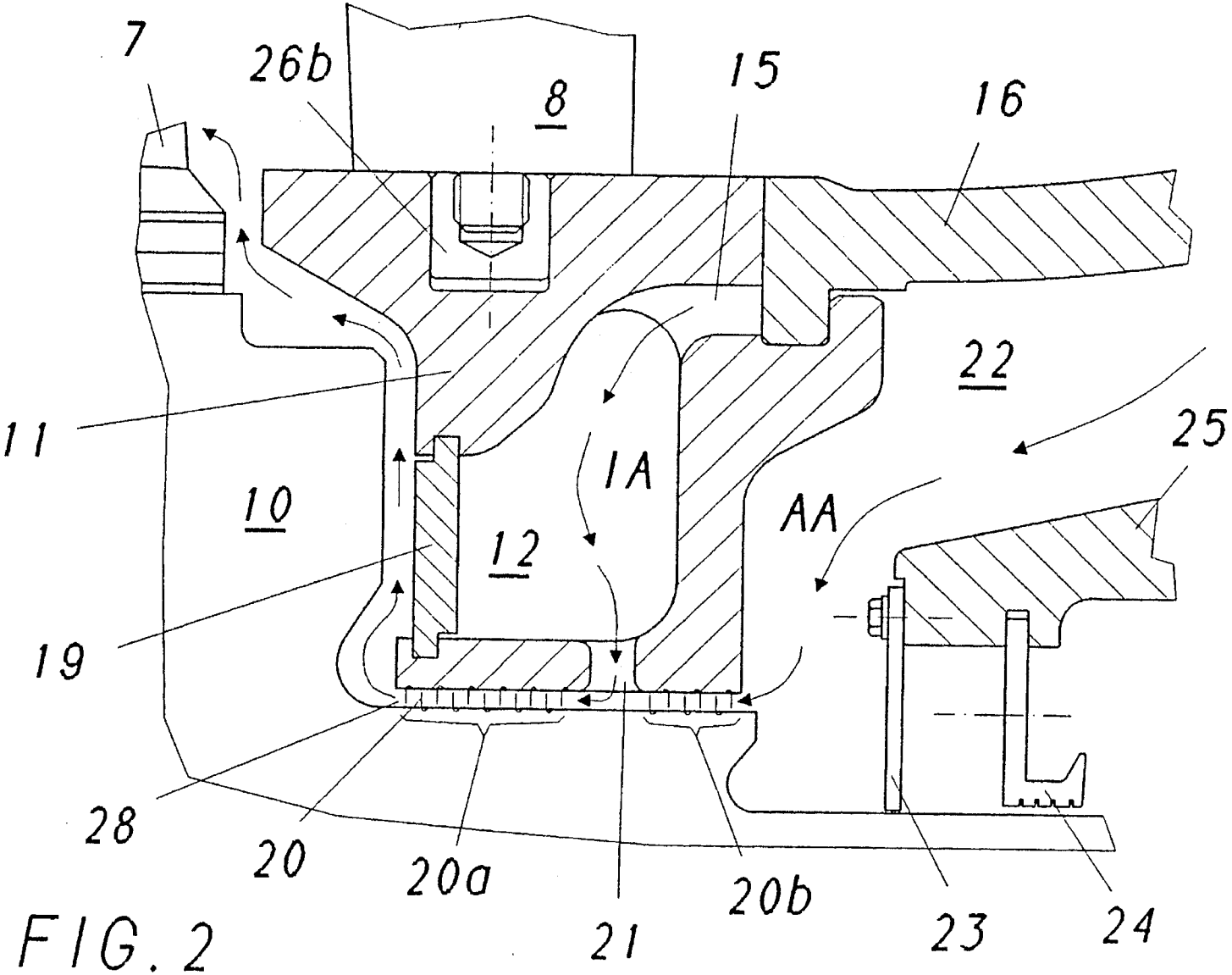
FIG. 2 shows, as an enlarged excerpt, the actual seal of a second embodiment example of the compressor according to the invention.

In the region of the rotor blades 7, the rotor shaft 10 is surrounded by a compressor casing 2 which has guide vanes (not shown) and which, together with the rotor, forms the actual compressor. The rotor shaft 10 is surrounded by an inlet casing 9 at the inlet end of the compressor 1. The inlet casing 9 consists of an outer shell 3 and an inner shell 16 between which is formed an inlet space 4 for the air to be compressed. The inlet space 4 is in connection with the surroundings at one end by means of an air inlet 5 provided with an inlet filter 6. It merges at the other end into an induction duct 27 equipped with inlet guide vanes 8. The outer shell 3 of the inlet casing 9 adjoins the compressor casing 2. The inlet guide vanes 8 are themselves adjustable at this point and are rotatably supported in the seal casing 11 by means of the vane bearings **26*a* in the compressor casing 2 and 26*b* (FIG. 2**).

In order to seal the downstream space behind the inlet guide vane 8, in which space there is a vacuum when the compressor is operated, against the ambient air, a seal casing 11 is provided at the end of the inner shell 16 facing toward the rotor blades 7. The seal casing 11 is located a small distance away at the periphery of the rotor shaft 10 and contains a sealing air chamber 12 from which sealing air can emerge into the annular gap 28 (FIG. 2) formed between the seal casing 11 and the rotor shaft 10. The rotor shaft 10 is supported at the inlet end by means of a shaft bearing 17 attached to the inner wall of a bearing housing 25.

The sealing air flowing out of the sealing air chamber 12 into the annular gap 28 is tapped from the inlet space 4. For this purpose, one or a plurality of sealing air passages 15 are provided which, for example, extend in the form of holes inside the inner shell 16 and connect the sealing air chamber 12 to the inlet space 4 by means of a respective sealing air inlet 13. Each sealing air passage 15 can then advantageously have a second inlet, which is closed in the normal case by a closing plate 14 but which, in a special case, permits the sealing air to be drawn from a separate, compressed air system connected to the arrangement. The tapping of the sealing air from the inlet space 4 has the special advantage that the sealing air, like the air to be compressed, has passed the inlet filter 6 and is therefore freed from damaging impurities to the same extent as the compressor air itself.

Figure 3:
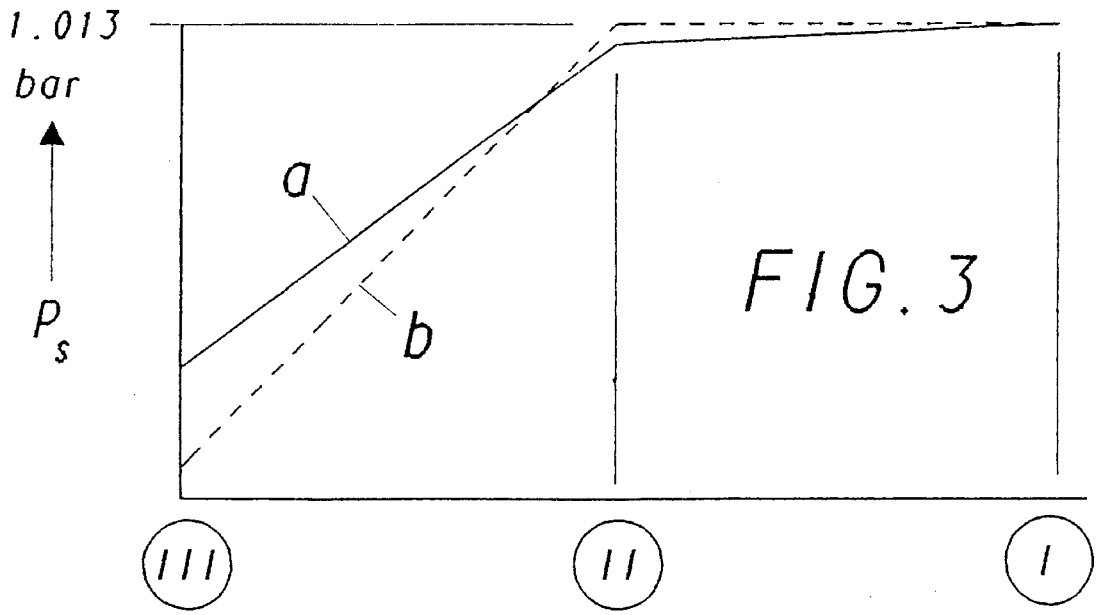
FIG. 3 shows a diagram of the pressure relationships in the induction region of the compressor of FIG. 1 without throttling (curve a) and with throttling (curve b)

The variation of the static pressure $P_s$ in the induction region of the compressor of FIG. 1 is shown diagrammatically in FIG. 3 for two different operating conditions, different positions in the induction region being indicated by the circled Roman numerals I to III. (I) designates the outside of the inlet filter 6, (II) designates the inlet space 4 and (III) designates the part of the induction duct 27 behind the inlet guide vanes 8 and before the first compressor stage.

The solid line curve (a) represents the variation of pressure for the case where the inlet guide vanes 8 are completely open, i.e. they are set to the position required for the compressor design point. In this case, the pressure falls slightly from the ambient condition to the inlet space 4 because the cross sections are large enough in this case. On the other hand, it falls more sharply in the induction duct 27 because in this case, the cross sections are correspondingly smaller and the air is correspondingly accelerated.

The interrupted line curve (b) represents the variation in pressure for the case where the inlet guide vanes 8 are in a throttling position rotated by a large angle, so that up to 50% less air reaches the compressor. In this case, the pressure drop in the induction duct is larger because of the increased flow resistance of the inlet guide vanes 8 compared with (a) whereas the curve towards the inlet space 4 becomes flatter because of the reduced flow.

The flow relationships in the sealing region itself can be explained by using the enlarged excerpt of FIG. 2. The seal casing 11 with the sealing air chamber 12, which is located on the inside and is closed by a closing ring 19, is attached to a flange-type end of the inner shell 16. The seal casing 11 surrounds the rotor shaft 10 at a small distance so that the annular gap 28 remains between the casing and the shaft. The sealing air IA (intake air) tapped from the inlet space 4 passes through the sealing air passage 15 into the sealing air chamber 12 and flows from there through sealing air openings 21 into the annular gap 28.

Ambient air (AA) at normal pressure is present on the right-hand side of the seal casing 11, in the ambient space 22. It is sealed against the shaft bearing by means of various seal elements 23, 24. The vacuum which occurs downstream behind the inlet guide vanes 8 when the compressor is in operation is largely present on the left-hand side of the seal casing 11. For this reason, there is a pressure gradient along the annular gap 28 and this drives ambient air AA and the sealing air IA emerging into the annular gap to the left through the annular gap.

Figure 6:
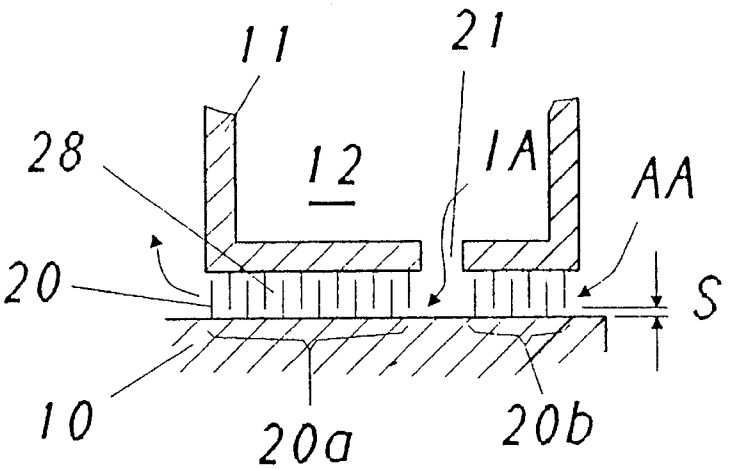
FIG. 6 shows the representation of the sealing geometry, associated with FIG. 5, on which the flows are based.
Figure 7:
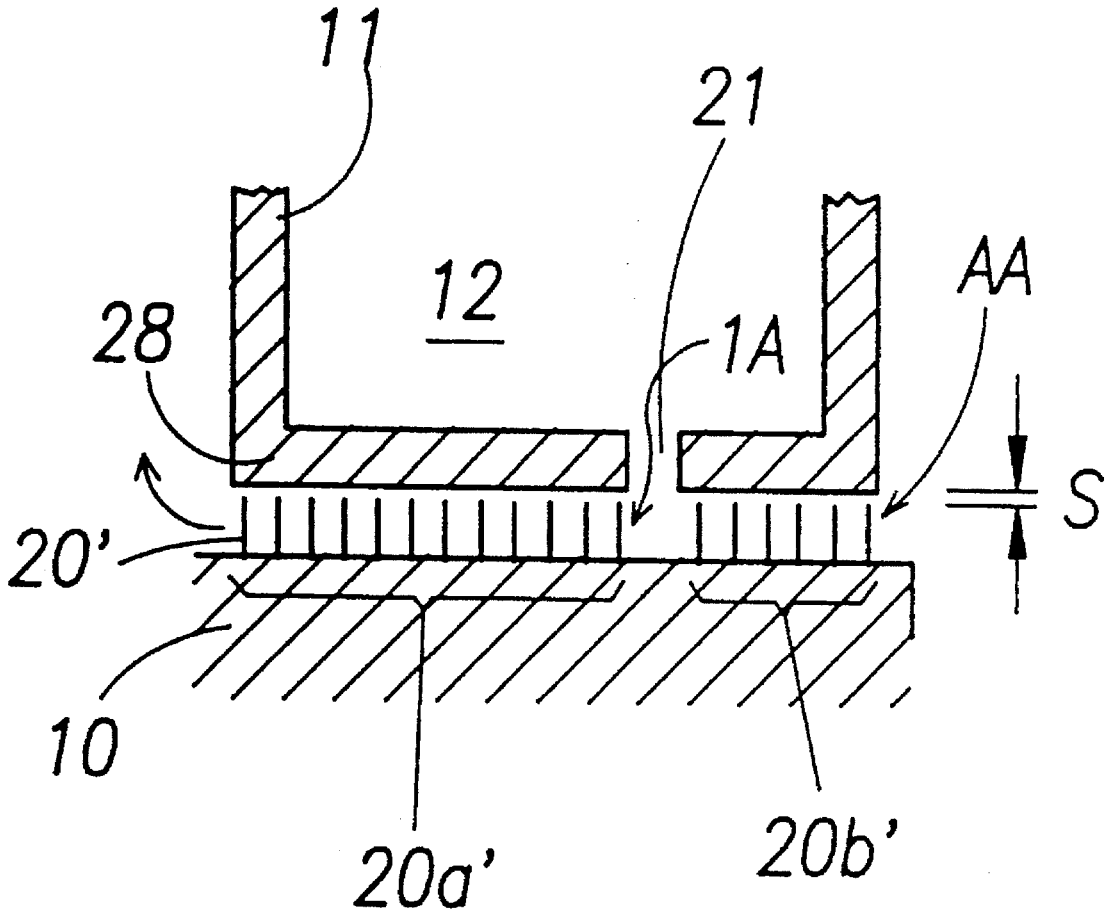
FIG. 7 shows an alternative arrangement of the sealing geometry in which the ribs are all attached to the rotor shaft.

The annular gap 28 itself has a thickness of some millimeters. The flow resistance in the annular gap 28 is increased by a plurality of sealing ribs 20 arranged one behind the other in the direction of the center line (see also FIG. 6). The sealing ribs 20 protrude into the annular gap 28 at right angles to the compressor center line 18, alternately from the inner wall of the seal casing 11 and the outer surface of the rotor shaft 10, and they define a radial clearance S by their distance from the respectively opposite wall (FIG. 6). This clearance is preferably approximately 1 mm. The totality of sealing ribs 20 is divided into two groups 20*a* and 20*b* of which one, 20*a*, is arranged behind the sealing air opening 21 in the flow direction and the other 20*b* is arranged in front of it. In accordance with an embodiment example which is shown in FIG. 7, the sealing ribs 20 can also be attached exclusively to the rotor shaft 10 instead of starting alternately from the inner wall of the seal casing 11 and the outer surface of the rotor shaft 10.

Figure 4:
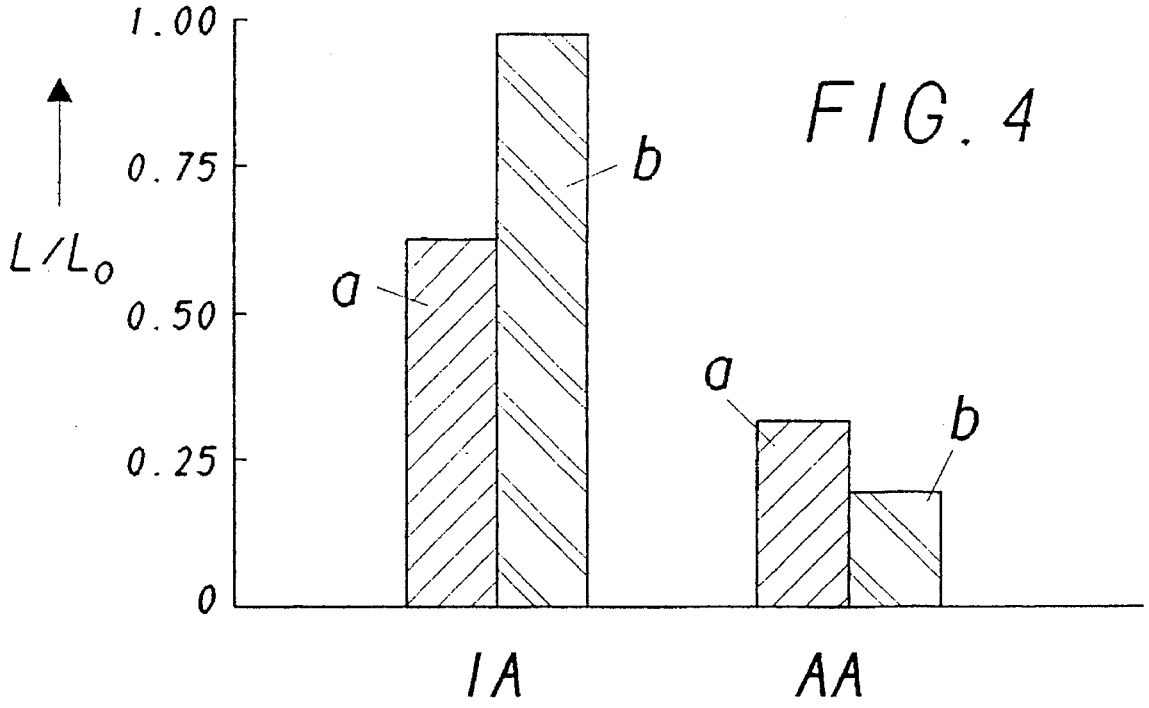
FIG. 4 shows, in a compressor in accordance with FIG. 2, leakage flows (L) of sealing air (intake air IA) and ambient air (ambient air AA) emerging at the annular gap, without throttling (a) and with throttling (b)

The number of ribs and their distribution in the two groups 20*a,b* of sealing ribs substantially determines the leakage flows of sealing air IA and ambient air AA through the annular gap. FIG. 2 represents the typical seal geometry of a large gas turbine compressor with nine pairs of sealing ribs 20, i.e. nine upper and nine lower sealing ribs. Of these ribs, six pairs are arranged in the group 20*a* and three pairs are arranged in the group 20*b*. At a radial clearance S of 1 mm, this arrangement gives the leakage flows L for IA and AA shown in the diagram in FIG. 4, where $L_0$ is the sum of the air quantities IA and AA in the case (a)—the example represented in FIG. 4. The case (a) again relates to the completely open inlet guide vanes 8 whereas the case (b) refers to the strongly throttled position already mentioned.

Figure 5:
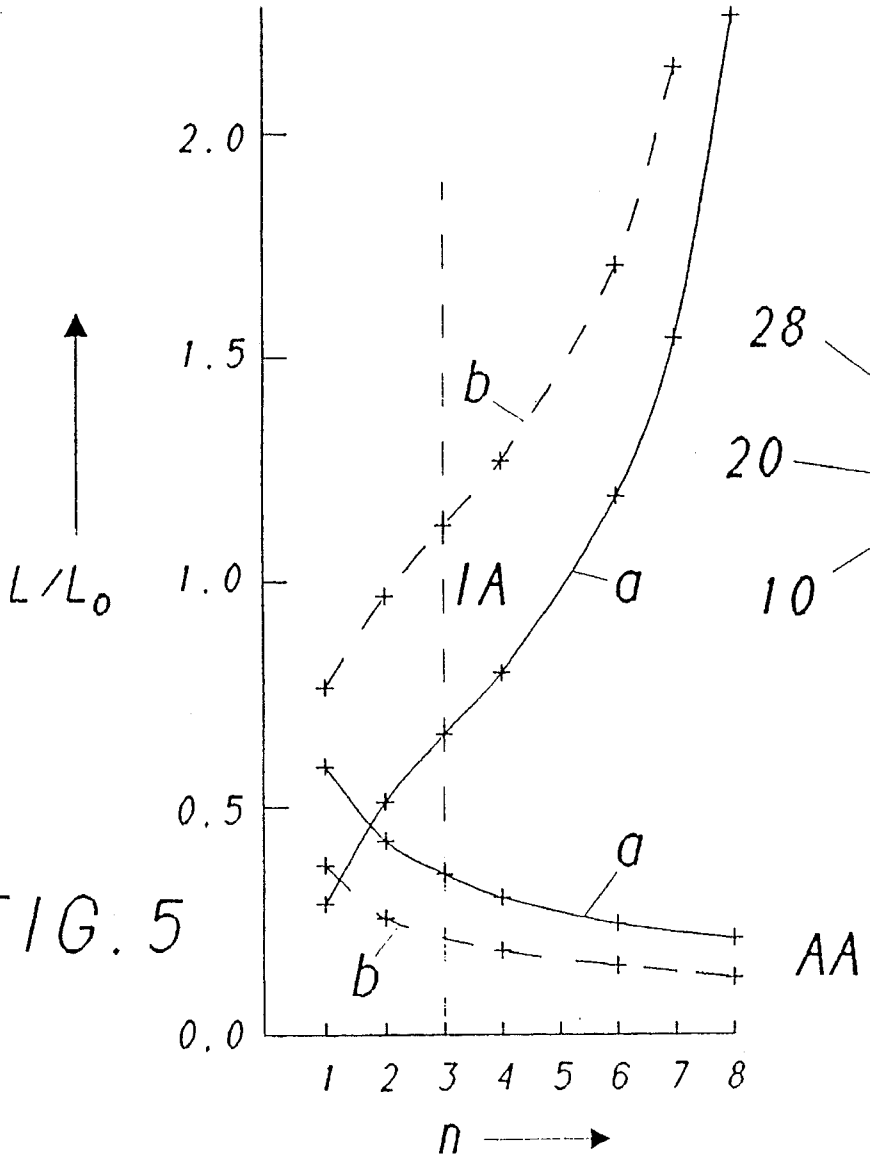
FIG. 5 shows the way the leakage flows (L) of FIG. 4 depend on the division of the sealing ribs in the annular gap.

Although the leakage flow L of ambient air AA cannot be completely prevented in the compressor according to the invention—in contrast to a conventional seal system operating with compressed air—it is nonetheless very small even in the least favorable case (a) and is further reduced when the compressor 1 operates throttled (case b). In addition, this leakage flow can be still further reduced, at the cost of bypassing the throttling, if the distribution of the sealing ribs 20 among the groups 20*a* and 20*b* is undertaken in a different manner. This can be seen from the diagram of FIG. 5 which refers to the seal geometry shown once again in FIG. 6. The diagram shows the change in the leakage flows L of the sealing air IA and the ambient air AA as a function of the number n of sealing rib pairs which, for a constant total number of nine pairs, are arranged in the group 20*b* (a and b refer again, in this case, to the mode of operation without and with throttling; furthermore, the case n=3 corresponds to the representation of FIG. 4). The invention can, of course, also be employed in compressors with rigid inlet guide vanes 8.

Overall, the invention provides a compressor which is distinguished by the following advantages:

the proportion of air which flows in past the inlet filter and enters the compressor system is negligibly small the seal does not require any compressed air supply conduits and control valves because the sealing air is tapped at an upstream position instead of a downstream position, there is an improvement in the sealing effect due to throttling by means of the inlet guide vanes 8.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compressor for a gas turbine, comprising:

(a) a rotor shaft mounted for rotation about a compressor center line and having a plurality of rotor blades fastened at a periphery;

(b) a compressor casing surrounding the rotor shaft and the rotor blades;

(c) an inlet casing surrounding the rotor shaft at an inlet end of the compressor and having an outer shell and an inner shell between which is formed an inlet space for air to be compressed, an air inlet provided with an inlet filter located at a first end of the inlet casing, and an induction duct equipped with inlet guide vanes attached at a second end of the inlet casing, the outer shell adjoining the compressor casing; and (d) a seal casing on an end of the inner shell facing the rotor blades and located at the periphery of the rotor shaft with an annular gap therebetween, the seal casing defining a sealing air chamber connected to the annular gap between the seal casing and the rotor shaft;

wherein, (e) the seal chamber is connected to the inlet space by at least one sealing air inlet and sealing air passage.

2. The compressor as claimed in claim 1, further comprising:

(a) a plurality of sealing ribs mounted in series on the rotor shaft in a direction of the compressor center line and extending in the annular gap between the seal casing and the rotor shaft, a radial clearance being defined by a distance from a free tip of each rib and the seal casing; and (b) wherein, the sealing ribs are positioned in two groups spaced apart and a sealing air opening connecting the sealing air chamber to the annular gap is arranged between the two groups.

3. The compressor as claimed in claim 1, further comprising:

(a) a plurality of sealing ribs mounted in series in a direction of the compressor center line to extend in the annular gap between the seal casing and the rotor shaft, the ribs positioned on an the seal casing and the rotor shaft in alternating relation, a radial clearance being defined by a distance from a free tip of each rib and an opposite side of the annular gap; and (b) wherein, the sealing ribs are positioned in two groups spaced apart and a sealing air opening connecting the sealing air chamber to the annular gap is arranged between the two groups.

4. The compressor as claimed in claim 3, wherein the group of sealing ribs arranged between the sealing air opening and ambient surroundings has a plurality of sealing rib pairs.

5. The compressor as claimed in claim 1, wherein the at least one sealing air passage extends within the inner shell of the inlet casing and wherein the at least one sealing air passage is connected with the inlet space by a sealing air inlet and has a separate closable connection for a separate compressed air conduit.

6. A compressor for a gas turbine, comprising:

(a) a rotor shaft rotatable about a compressor center line and having a plurality of rotor blades fastened at a periphery;

(b) a compressor casing surrounding the rotor shaft and the rotor blades;

(c) an inlet casing surrounding the rotor shaft at an inlet end of the compressor and having an outer shell and an inner shell between which is formed an inlet space for air to be compressed, an air inlet provided with an inlet filter located at a first end of the inlet casing, and an induction duct equipped with inlet guide vanes attached at a second end of the inlet casing, the outer shell adjoining the compressor casing; and (d) a seal casing on an end of the inner shell facing the rotor blades and located at the periphery of the rotor shaft with an annular gap therebetween, the seal casing defining a sealing air chamber connected to the annular gap between the seal casing and the rotor shaft;

(e) a plurality of sealing ribs mounted in series in a direction of the compressor center line and extending in the annular gap between the seal casing and the rotor shaft, the ribs mounted on the seal casing and the rotor shaft in alternating relation, a radial clearance being defined by a distance from a free tip of each rib and an opposite side of the annular gap;

wherein, (f) at least one sealing air passage connects the seal chamber to the inlet space; and (g) the sealing ribs are positioned in two spaced apart groups and a sealing air opening connecting the sealing air chamber to the annular gap is arranged between the two groups.

7. A compressor for a gas turbine, comprising:

(a) a rotor shaft rotatable about a compressor center line and having a plurality of rotor blades fastened at a periphery;

(b) a compressor casing surrounding the rotor shaft and the rotor blades;

(c) an inlet casing surrounding the rotor shaft at an inlet end of the compressor and having an outer shell and an inner shell between which is formed an inlet space for air to be compressed, an air inlet provided with an inlet filter located at a first end of the inlet casing, and an induction duct equipped with inlet guide vanes attached at a second end of the inlet casing, the outer shell adjoining the compressor casing; and (d) a seal casing on an end of the inner shell facing the rotor blades and located at the periphery of the rotor shaft with an annular gap therebetween, the seal casing defining a sealing air chamber connected to the annular gap between the seal casing and the rotor shaft;

(e) a plurality of sealing ribs mounted in series in a direction of the compressor center line and extending in the annular gap between the seal casing and the rotor shaft, a radial clearance being defined by a distance from a free tip of each rib and an opposite side of the annular gap;

wherein, (f) at least one sealing air passage connects the seal chamber to the inlet space; and (g) the sealing ribs are positioned in two spaced apart groups and a sealing air opening connecting the sealing air chamber to the annular gap is arranged between the two groups.

* * * * *